United States Patent [19]

Branham et al.

[11] 4,046,471

[45] Sept. 6, 1977

[54] DUAL MODE ELECTROPHOTOGRAPHIC APPARATUS HAVING DUAL FUNCTION PRINTING BEAM

[75] Inventors: Charles Escom Branham, Boulder; Thomas Dean Steury, Longmont; John Maury Woodward, Boulder, all of Colo.

[73] Assignee: International Business Machines Corporation, Armonk, N.Y.

[21] Appl. No.: 628,034

[22] Filed: Nov. 3, 1975

[51] Int. Cl.[2] ..... G03G 15/00

[52] U.S. Cl. ..... 355/14; 346/160; 355/3 R; 358/300

[58] Field of Search ..... 355/1, 3 R, 14; 331/DIG. 1; 178/6.6 A; 346/160; 358/297, 300

[56] References Cited

U.S. PATENT DOCUMENTS

| | | | |
|---|---|---|---|
| 2,551,582 | 5/1951 | Carlson | 96/1 R |
| 3,358,081 | 12/1967 | Young et al. | 355/3 R X |
| 3,597,071 | 7/1971 | Jones | 355/3 R |
| 3,681,527 | 8/1972 | Nishiyama et al. | 178/6.6 A |
| 3,751,155 | 8/1973 | Liechty | 355/14 X |
| 3,809,472 | 5/1974 | Liechty | 355/3 R |
| 3,834,807 | 9/1974 | Fuller et al. | 355/3 R |
| 3,898,627 | 8/1975 | Hooker et al. | 355/3 R X |
| 3,912,387 | 10/1975 | Brooke | 355/3 R |

FOREIGN PATENT DOCUMENTS

| | | | |
|---|---|---|---|
| 1,366,052 | 9/1974 | United Kingdom | 355/3 R |

OTHER PUBLICATIONS

R. A. Thorpe, "Triple Function Box", IBM Technical Disclosure Bulletin, Mar. 1973, vol. 15, No. 10, pp. 3259–3260.

*Primary Examiner*—Fred L. Braun
*Attorney, Agent, or Firm*—Francis A. Sirr

[57] ABSTRACT

A dual mode xerographic copier/printer is selectively operable to form a latent image of an original document on a photoconductor, or to raster-scan the photoconductor with a laser printing beam which is under the control of a binary-data-defined image to thereby form a latent image thereof.

The latent image, whether it is formed in the copy mode or the print mode, is toner developed. The developed image is then transferred to a sheet of copy paper. This copy paper may be of variable size.

In the copy mode, the laser printing beam is controlled to erase the photoconductor bordering that photoconductor area which will coincide with the sheet during transfer, i.e., bordering the latent image of the original document.

In the print mode, a data processor formats the binary-data-defined image to fit into a photoconductor area compatible with the size of the copy paper. The resulting electrical signals then control the laser printing beam to erase the entire photoconductor, exclusive of the binary-data-defined image.

9 Claims, 5 Drawing Figures

DUAL MODE ELECTROPHOTOGRAPHIC APPARATUS HAVING DUAL FUNCTION PRINTING BEAM

BACKGROUND OF THE INVENTION

This invention relates to the field of electrophotography, and more particularly to a dual mode electrophotographic apparatus which can be selectively operated in a copy mode, to copy an original document, or in a print mode, to form a document from an electrical-data-defined image. More specifically, this invention provides a raster scanning mechanism, for example a laser, which is operable in both modes of operation. In the copy mode, the scanning mechanism erases an area of the photoconductor exclusive of a working area into which the image of the original document is reflected. In the print mode, the scanning mechanism erases the entire photoconductor exclusive of the data-defined image.

While dual mode electrophotographic copier/printers are known, it is not known to make double use of the raster scanning mechanism to border-erase in the copy mode, and to total-erase in the print mode.

In addition, electrophotographic copiers are known wherein a working portion of a photoconductor is illuminated by the reflected image of an original document, and wherein the remaining portion of the photoconductor is illuminated, or erased, by light sources which are provided for only this purpose.

The present invention eliminates the need for such erase light sources by the dual utilization of the printer raster scanning mechanism record print information when in the print mode, and to discharge the photoconductor bordering the reflected original document image when in the copy mode.

The foregoing and other features and advantages of the invention will be apparent from the following more particular description of a preferred embodiment of the invention, as illustrated in the accompanying drawing.

INCORPORATION OF A COPENDING APPLICATION AND PATENTS BY REFERENCE THERETO

The copending application of R. R. Schomburg, Ser. No. 506,806, filed Sept. 17, 1974, and commonly assigned, is incorporated herein by reference, which application is in turn a continuation-in-part of application Ser. No. 408,980, filed Oct. 23, 1973, now abandoned.

This copending application describes an optical printer character generator wherein a character generation control register independently stores, for each row of text to be generated, the order position of an alphanumeric character being generated and the remaining number of raster scans required to complete generation of the character. This control register enables the generation of symbols, that are allotted different relative widths, by a printer having a modulated light spot that scans the entire length of a page in the direction normal to the writing lines on the page. The control register also enables the text which is assembled in a page memory to be generated in reading lines of text that extend either parallel or normal to the direction of light spot scanning by selecting alternate page memory access sequences. By the use of "white space" indicating control codes in combination with the control register of this copending application, it is possible to materially reduce the size of memory required to store a page of text.

U.S. Pat. No. 3,898,627, issued on Aug. 5, 1975 to R. W. Hooker et al, is incorporated herein by reference.

This patent describes a serializing buffer for use, for example in the structure described in the above-mentioned copending application Ser. No. 506,806, to control the conversion of variable length, parallel character identifying binary data words into an unbroken serial binary bit stream which is operable to control the laser beam deflection by way of an acousto-optic modulator, the binary state of a bit defining the light/dark contrast pattern required for generating printed pages of an electrophotographic printer.

U.S. Pat. No. 3,835,249, issued on Sept. 10, 1974 to A. J. Dattilo et al, is incorporated herein by reference.

This patent describes a synchronization system for a scanning laser beam which selectively discharges a photoconductor in accordance with beam modulation achieved by a beam modulator. Specifically, synchronization is achieved by a beam splitter which directs a portion of a laser beam through an optical grating to an elliptical mirror. Reflection from the mirror impacts a photodetector. This photodetector generates a clock signal which is operable to gate a serial binary bit stream to the modulator, thus synchronizing the binary data flow to the beam sweeping the photoconductor.

DESCRIPTION OF THE PREFERRED EMBODIMENT

Figure 1:
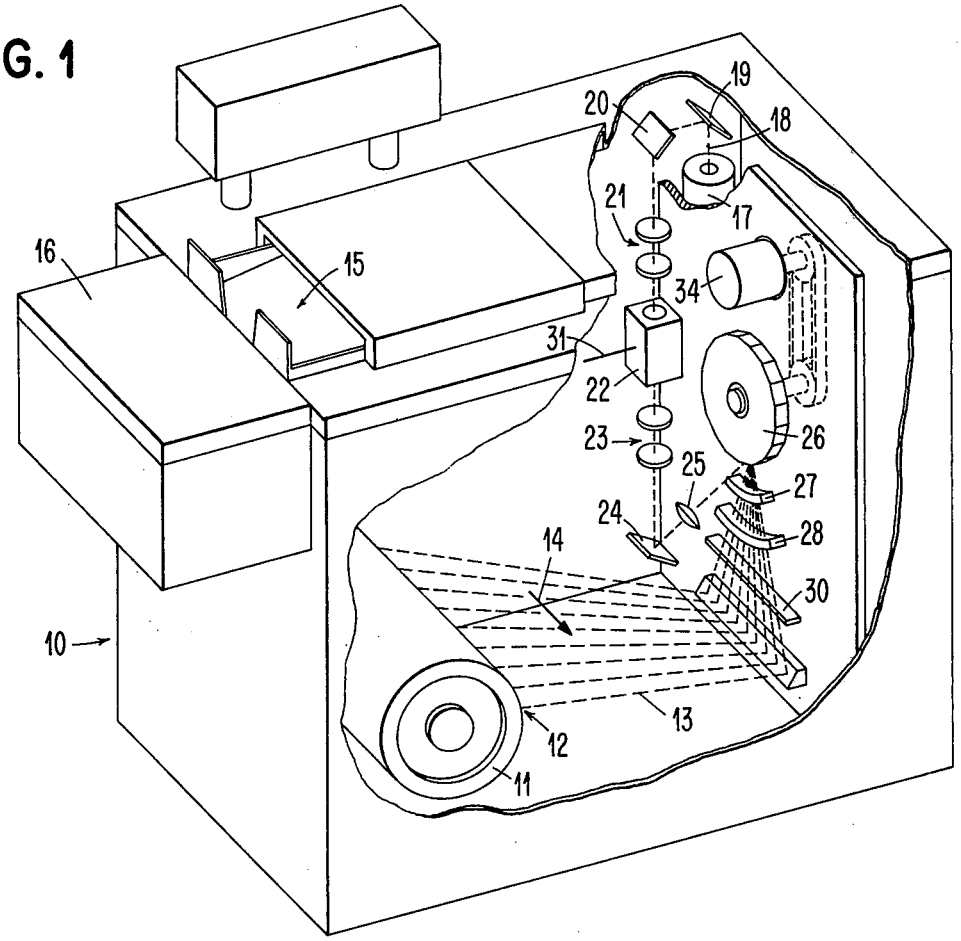
FIG. 1 is a front perspective view of a dual mode electrophotographic apparatus embodying the present invention, wherein a portion of the apparatus housing is broken away to better show the beam scanning mechanism, and wherein the illumination apparatus which causes a reflected image of an original document to be reflected in line-scan fashion onto the drum photoconductor has been eliminated to simplify the showing.
Figure 2:
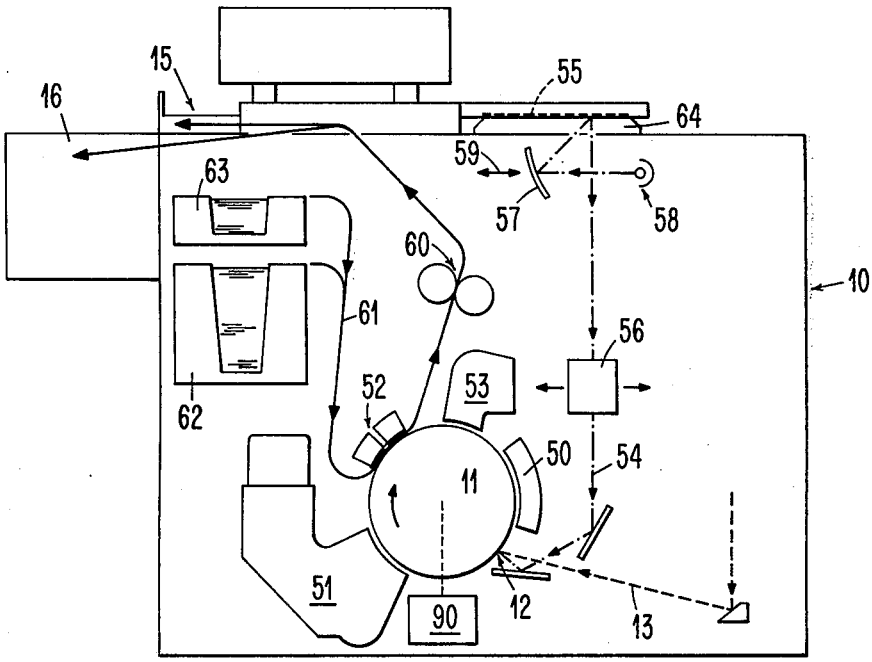
FIG. 2 is a front view of the apparatus of FIG. 1, showing the scanning optical mechanism which is operable in the copy mode to reflect an original document to the photoconductor.

FIGS. 1 and 2 show a dual motor electrophotographic apparatus 10 incorporating the present invention.

Details of an electrophotographic apparatus are well known to those skilled in the art and form no part of this invention. It is to be understood that a variety of techniques exists for performing the various functions identified.

With reference to FIG. 2, apparatus 10 includes a photoconductor drum 11 providing an image receiving photoconductor surface. Drum 11 is rotated past a charging station 50, an exposure station 12, a development station 51, a transfer station 52 and a cleaning station 53. At the exposure station the uniform electrical charge which was applied to the photoconductor at the charging station is selectively dissipated. In the copy mode, this charge dissipation is accomplished by FIG. 2's reflected footprint of light 54. In the print mode this charge dissipation is accomplished by a binary (i.e., on/off) light beam 13 that traverses path 14 (FIG. 1) extending parallel to the drum's axis of rotation.

Footprint 54 extends a substantial axial portion of drum 11 and is operable to discharge a working area of the photoconductor in accordance with the reflectance characteristic of a stationary original document 55. Document 55 is line-scanned by movable lens 56 and reflector 57. Light source 58 cooperates with reflector 57 to illuminate the original document with a footprint of light. This light footprint extends normal to scan direction 59. Document 55 is placed on the document glass with its length dimension normal to scan direction 59. The area of photoconductor drum 11 which is line-scanned by this reflected footprint is defined as the photoconductor's working area; i.e., it is the area which contains the reflected image to be reproduced. In accordance with the present invention, the photoconductor area bordering this working area is scanned and discharged by a dual-use laser beam.

This laser beam is identified by reference number 13 in FIGS. 1 and 2. Selective photoconductor exposure by beam 13 generates discrete areas of an electrostatic latent image consisting of discharged areas (defined as background areas) and charged areas (defined as image areas). The background areas will not attract toner when passing through developer 51 (FIG. 2), whereas the image areas will be toned.

The photoconductor's latent image, in either the copy or print mode, is presented to development station 51 (FIG. 2) where colored thermoplastic resin powder or toner is selectively deposited on only the charged image areas. Thereafter the developed image is transferred to a paper sheet, as by electrostatic force, at transfer station 52. The printed sheet is then passed through fixing station 60 in the form of a hot roll fuser where heat, or other suitable means, temporarily liquifies the toner, causing it to adhere to the sheet and to form a permanent image thereon. The sheet is then delivered to exit pocket or tray 15, or to bin 16 (FIG. 1), where it can be removed. Any toner remaining on the photoconductor, as it leaves the transfer station, is cleaned at the cleaning station prior to recharging of the photoconductor. Paper is selectively supplied to sheet path 61 from a primary bin 62 or a secondary bin 63 wherein stacks of cut sheets are stored with their length dimension oriented normal to the direction of sheet feed. These two bins allow the use of sheets of different length, and allow manual selection of a sheet length most nearly corresponding to the length of original document 55.

Figure 3:
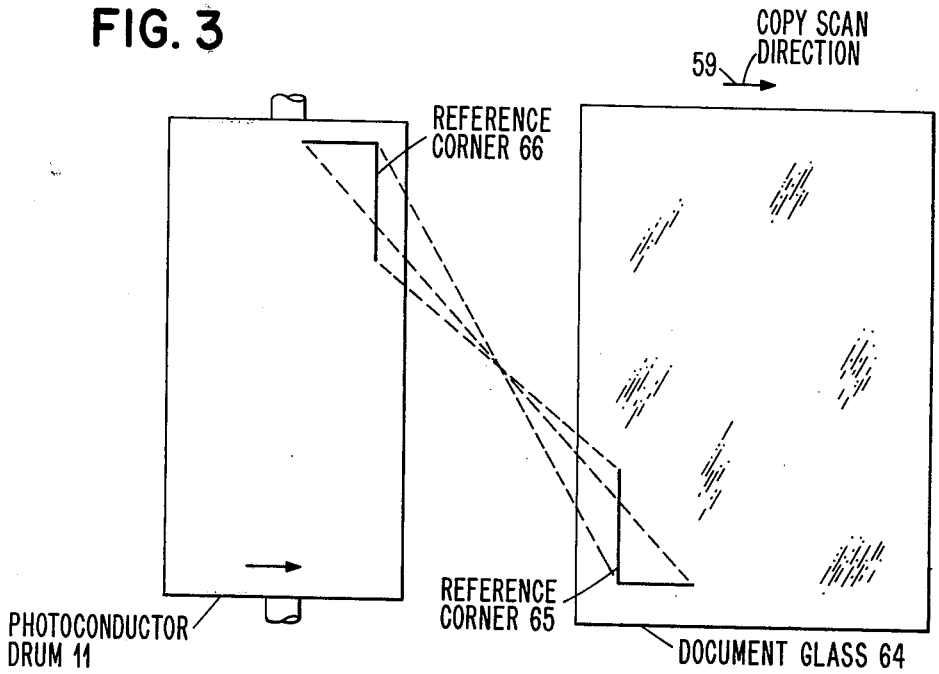
FIG. 3 is a diagrammatic view of a portion of FIG. 2, showing FIG. 2's document glass, upon which an original document is placed in registry with a reference corner, and the manner in which the lens of FIG. 2 operates to project a reflected image of the original document onto the moving surface of the photoconductor drum.

With reference to FIG. 3, the document glass 64 upon which FIG. 2's original document 55 is placed is shown in top view. All original documents are left-front-corner referenced to reference corner indicia 65. Thus, the reflection optics, including lens 56 of FIG. 2, is operable to reflect this reference corner inverted to the clockwise rotating photoconductor drum 11, as at 66.

Photoconductor drum 11 may be of the type wherein a flexible photoconductor web is carried on the rigid metallic surface of a drum. The photoconductor is stored in flexible strip form on supply and take-up rolls located within the drum's interior. The portion of the photoconductor extending between the two rolls encircles the drum and is active in the electrophotographic process. In order to change the active photoconductor portion, a length of the photoconductor is advanced from the supply roll to the take-up roll. The drum's surface includes an axially extending slot whereat the photoconductor enters and exits the drum's interior. This slot is closed by a seal strip. U.S. Pat. No. 3,588,242, issued to R. A. Berlier et al is an example of such a photoconductor drum structure.

With reference to FIG. 1, light beam 13 is preferably generated from a source of high energy coherent light, such as a continuous mode helium-neon laser 17 that projects a beam 18 along an optical path through mirrors 19 and 20, compression optics 21, binary-controlled electro-optic laser beam modulator 22, expansion optics 23, mirror 24, lens 25, rotating scanning mirror 26, lens 27, projection lens 28, a beam splitting partial mirror 29 (shown in FIG. 4) and beam blocking knife edge 30, to the photoconductor drum. Modulator 22 is an acoustooptic Bragg effect device known to those skilled in the art. Modulator 22 responds to the binary state (1 or 0) of the electrical information bit on its input line 31 to thereby emit beam 18 in either of two closely adjacent but slightly different output paths 32 or 33; see FIG. 4. Beam 33 is the deflected first order beam. Beam 32 is the undeflected zero order beam. As well known to those skilled in the art, a binary 0 on conductor 31 results in no excitation of modulator 22 and only zero order beam 32 results. When a binary 1 exists on conductor 31, the modulator is energized and approximately 90% of the beam's energy is deflected to first order 33. If beam 18 is emitted along output path 33, it will ultimately be directed past knife edge 30 and will strike the photoconductive surface as beam 13 (FIG. 1) to discharge the photoconductor and thereby ultimately cause a background area (an untoned area) to be produced on the copy sheet. Light emitted along path 32 is intercepted by knife edge 30 and thus does not strike the photoconductor. The resulting undischarged photoconductor area will attract toner at the developing station, to thus form part of the colored image on the copy sheet.

Lenses 25 and 27 comprise tilt correction optics of the type described in U.S. Pat. No. 3,750,189, issued to J. M. Fleischer.

Scan mirror 26 receives the laser beam along both paths 32 and 33 and redirects the beam toward knife edge 30. Mirror 26 is configured as a regular polygon and is driven by motor 34 at a substantially constant speed, this speed being chosen with regard to the rotational speed of drum 11 and the size of beam 13, such that individual raster scanning strokes of beam 13 traverse immediately adjacent areas on the photoconductor surface to provide a full surface exposing raster.

Figure 4:
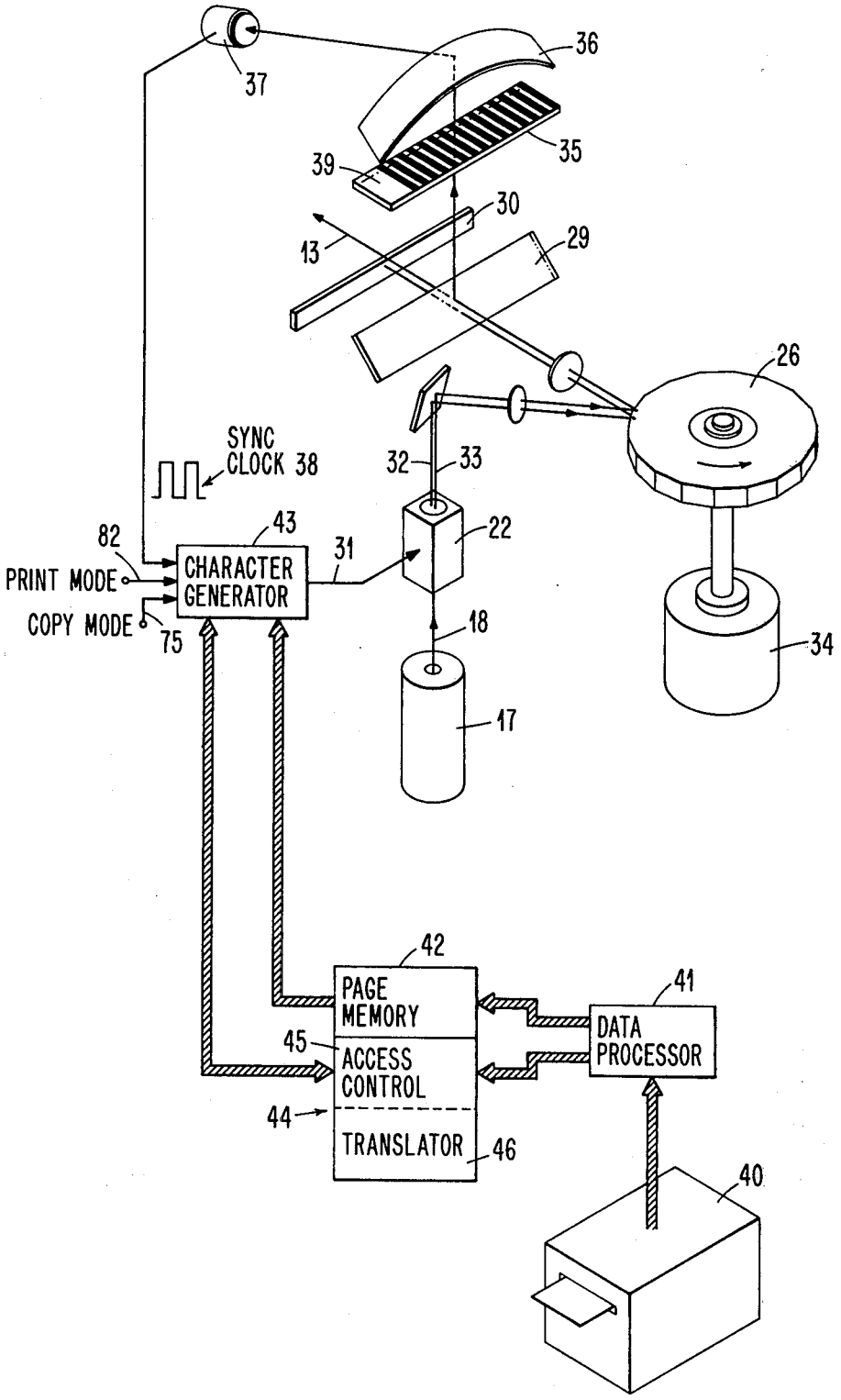
FIG. 4 is a diagrammatic view showing the electronic organization of FIG. 1's beam scanning printer, having a character generator constructed in accordance with the teachings of later-mentioned copending application Ser. No. 506,806, filed Sept. 17, 1974, now abandoned and also having a serializing buffer constructed in accordance with the teachings of later-mentioned U.S. Pat. No. 3,898,627.

With reference to FIG. 4, beam splitting mirror 29 intercepts a fraction of the laser beam along both paths 32 and 33, as the beam is moved through its scanning motion by mirror 26. Mirror 29 diverts this portion of the beam energy through optical grating 35 to elliptical mirror 36. Mirror 36 causes light to be reflected to a photodetector 37 which is positioned at one focus of mirror 36. Scan mirror 26 is located at the other focus of mirror 36. The optical geometry of the system is selected such that grating 35 and exposure station 12 (FIG. 2) are positioned equivalently located. Photodetector 37 thus creates an electrical signal pulse train of clocking pulses 38 (i.e., a read-clock) that is a direct measure of the scanning movement of the laser beam relative to the photoconductor. The pulses produced at photodetector 37 define the rate at which image elements or dots are to be defined by modulator 22, thereby enabling photodetector 37 to directly generate a gating or read-clock signal for control of modulator 22. A continuous transparent portion 39 of grating 35 is provided to enable detection of the completion of each raster scan.

The above-described means, including grating 35, which is operable to detect the position of the scanning laser beam, and thus clock the serial binary data stream into modulator 22, is of the type described in U.S. Pat. No. 3,835,249, issued to A. J. Dattilo et al.

By way of example, the dot density of a scan along path 14, to thereby generate a columnar segment, may be 240 dots per inch, thereby requiring a grating 35 having 120 opaque lines per inch. The orthogonal dot density, measured along the circumferential direction of drum 11, may also be 240 dots per inch.

A source of electrical page text data, such as derived, for example, from a magnetic card or tape reading device 40, delivers the page text data image to be printed to data processing apparatus 41. In this manner, the text data is assembled and stored in page memory 42. Each character or symbol to be printed, as well as the spaces to be inserted between characters, are stored in page memory 42 at individual memory addresses which are, in turn, associated with the writing lines of the page and with the order position of the character within the writing line.

Once the text has been assembled in page memory 42, character generator 43 operates to provide the necessary binary dot pattern control of modulator 22 in order to reproduce a visual image of the page text. In addition to page memory 42, both data processor 41 and character generator 43 have access to an additional memory 44. This additional memory includes a page memory address control register 45 and a reference address and escapement value table or translator 46.

For a more complete description of FIG. 4's electronic organization, reference may be made to abovementioned copending application Ser. No. 506,806, and U.S. Pat. No. 3,898,627.

Figure 5:
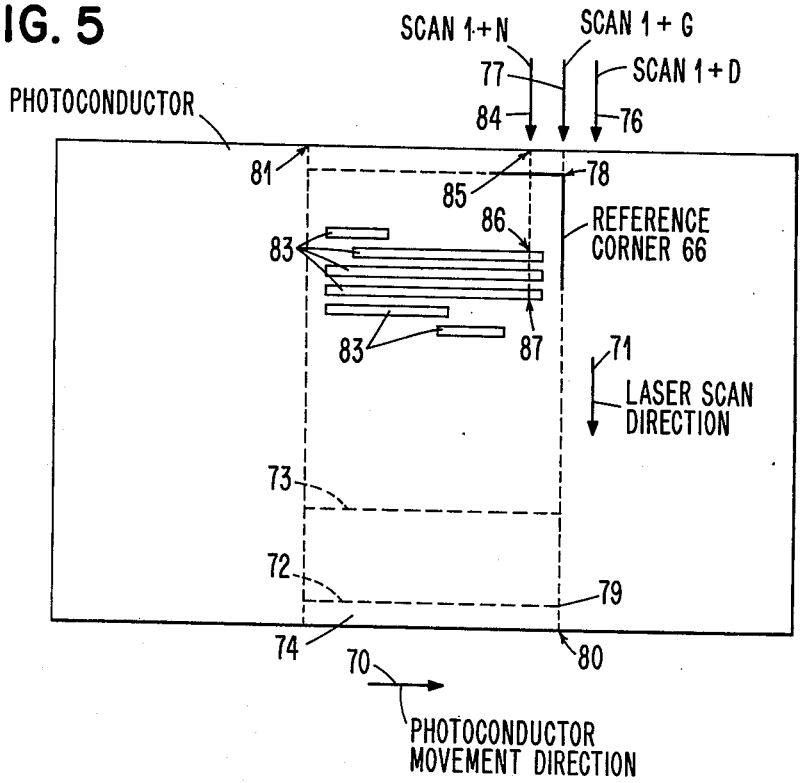
FIG. 5 is a view of FIG. 1's drum photoconductor "unrolled", to thereby facilitate an explanation of the relationship of the photoconductor's working area, as defined by the size copy paper currently in use, and the manner in which the scanning laser beam cooperates with the photoconductor in the copy and the print modes.

With reference to FIG. 5, this figure shows the photoconductor of drum 11 "unrolled" to a flat state. Reference corner 66, shown in FIG. 3, is likewise identified in FIG. 5. The direction of photoconductor movement is indicated by arrow 70, and the direction of laser scan is indicated by arrow 71. Rectangular dotted outline 72 surrounds the photoconductor's working area which will be contiguous with a sheet of paper supplied to FIG. 2's transfer station 51 from either of the bins 62 or 63. Rectangular dotted outline 73 represents the photoconductor's working area when a shorter length sheet of paper is supplied, for example, from secondary bin 63. In any event, the area bounded by broken lines 72 and 73, and including reference corner 66, is the photoconductor's working area. Since the entire photoconductor is charged at FIG. 2's charging station 50, the photoconductor area 74 which borders working area 72 must be discharged prior to the photoconductor passing through FIG. 2's developer 51.

Assuming that the apparatus is in the copy mode, the photoconductor's working area will be illuminated by the apparatus of FIG. 2. With reference to FIG. 4, an indication that the apparatus is in the copy mode is provided on conductor 75. This signal also indicates the size of the photoconductor's working area, i.e., the size copy paper in use. This conductor is operable to control modulator 22 such that FIG. 5's border area 74 is completely discharged. For example, laser scan "1+D", represented by arrow 76, is controlled such that a continuous first order beam 33 is generated, causing this portion of the photoconductor to be totally discharged or erased, from the left-hand border to the right-hand border as shown in FIG. 5. As photoconductor movement progresses, in direction 70, drum position sensing transducer 90, FIG. 2, signals the approach of the upper border of working area 72. When the scan identified as "1+G", and represented by arrow 77, begins, the first order beam is continuously generated only until the corner 78 of the working area is reached. Thereafter, modulator 22 is deenergized and the zero order beam 32 is produced, such that the beam does not impact the photoconductor from point 78 to point 79. However, from point 79 to point 80 the modulator is again continuously energized to produce a continuous first order beam 33. This control of modulator 22 continues until the bottom edge of working area 72 is reached, as by the scan which begins at point 81, whereupon modulator 22 is again continuously energized to totally discharge or erase the bottom portion of the photoconductor's border area 74.

Considering now the operation of the appparatus when it is in its print mode, in this case command conductor 82 (FIG. 4) signals character generator 43, indicating not only that the apparatus is in the print mode, but also indicating the size copy paper, that the size of the photoconductor's working area 72, within which the content of page memory 42 is to be placed. Thus, the control of modulator 22, when in the print mode, is operable to erase the total photoconductor area of FIG. 5, exclusive of the image to be printed, this image being represented by blocks 83. Considering, for example, scan "1+N" identified by arrow 84, this scan begins at point 85 with modulator 22 energized to produce first order beam 33. This state continues to point 86 whereat the modulator is now controlled by a binary bit stream whose data content defines the columnar scan portion of an alphanumeric character within block 83. As the laser scan progressed to the interline area between block 83 and the next right-most block, the modulator again is controlled to continuously provide the first order beam. This operation continues along scan N+1 until the effective end of scan is reached at point 87. This is defined as the end of scan since, as can be seen from FIG. 5, the remaining right-hand portion of the 1+N scan consists of total discharged or erased photoconductor.

Thus, in the print mode, no distinction is made between the working and nonworking areas of the photoconductor. Rather, each individual scan of the laser beam, exclusive of the data defined image which is to be placed in blocks 83 shown in FIG. 5, is composed of an on-state of modulator 22 wherein the photoconductor is erased.

Information as to the size of the copy sheet to be supplied to transfer station 52, if different sizes are to be supplied, is necessary in order to control the laser to implement border erase when in the copy mode. This same copy sheet size information is used in the print mode to enable the data defined image in page memory 42 to be placed within this sheet size.

Apparatus constructed in accordance with the present invention may not provide for variable copy sheet size, whereupon the laser is controlled, in the copy mode, to erase the border around the standard size copy sheet in use, and, in the print mode, the text data is formatted to fit within this standard size.

While the invention has been particularly shown and described with reference to a preferred embodiment thereof, it will be understood by those skilled in the art that various changes in form and details may be made therein without departing from the spirit and scope of the invention.

What is claimed is:

1. In an electrophotographic copier/printer apparatus having a copier illumination station operable to image an original document onto a photoconductor, having a printing beam scanner station operable to raster scan said photoconductor as said beam scanner is controlled by a data-defined image, and having a copy sheet supply station operable to supply copy sheets, said copy sheets being synchronously fed to a transfer station adjacent said photoconductor as said apparatus selectively operates in the copier or printer mode; the improvement comprising:

border erase means operable in the copy mode to cause said beam scanner station to erase the area of said photoconductor bordering an image area equal to the sheet size; and electrical image processing means operable in the print mode to erase all areas of said photoconductor with the exception of said data-defined image.

2. The apparatus defined in claim 1 wherein said photoconductor moves past said copier illumination station whereat a reflected image of the original document is flow-scanned onto said photoconductor, and past said beam scanner station whereat said beam scanner raster scans said photoconductor, including photoconductor position sensing means operable to control both said flow-scanning and said border erase means to thereby synchronize the operation of said beam scanner station to the position of said photoconductor.

3. The apparatus defined in claim 2 wherein said copier illumination station and said beam scanner station are located at substantially the same point along the movement path of said photoconductor.

4. The apparatus defined in claim 3 wherein said beam scanner station includes a laser and a laser modulator, and means connecting said electrical image processing means in controlling relation to said modulator.

5. A dual mode of operation electrophotographic copier/printer apparatus wherein a charged photoconductor is discharged in accordance with an image to be reproduced;

optical means operable to discharge said photoconductor in accordance with the reflected image of an original document when said apparatus is in the copier mode of operation;

electrical means operable to supply an output signal whose time varying characteristics define a visual image;

a raster scanning beam controlled by said electrical means and operable to discharge said photoconductor in accordance with said time varying characteristics when said apparatus is in the printer mode of operation; and border discharging means operable when said apparatus is in the copier mode of operation to control said raster scanning beam to discharge the area of said photoconductor bordering the area which coincides with the reflected image of said original document.

6. The apparatus defined in claim 5 wherein said photoconductor is movable relative to said optical means and said scanning beam, and including first synchronizing means operable when said apparatus is in the copier mode of operation, and responsive to movement of said photoconductor, said first synchronizing means being operable to synchronize operation of said optical means and said border discharging means.

7. The apparatus defined in claim 6 including second synchronizing means operable when said apparatus is in the printer mode of operation, and responsive to movement of said photoconductor, said second synchronizing means being operable to synchronize operation of said electrical means to the position of said photoconductor.

8. The apparatus defined in claim 7 wherein said raster scanning beam includes a laser and a laser modulator, and wherein the output signal of said electrical means is connected in controlling relation to said modulator.

9. A dual mode of operation electrophotographic copier/printer apparatus wherein a latent image is formed on a photoconductor as said apparatus operates in a copy or a print mode, charging means operable to charge said photoconductor, raster scanning means operable in both the copy and print mode to discharge a border portion of said photoconductor to thereby form a residual charged area, copy means operable in the copy mode to discharge said residual area in accordance with the reflected image of an original document, and print means operable in the print mode to discharge said residual are in accordance with an electrical signal which defines an image to be printed, only one of said copy means or said print means being operable at any given time.

* * * * *